US006948546B2

(12) United States Patent
Nien

(10) Patent No.: US 6,948,546 B2
(45) Date of Patent: Sep. 27, 2005

(54) CORD RETAINING DEVICE FOR NON-CORD VENETIAN BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/805,300

(22) Filed: Mar. 22, 2004

(65) Prior Publication Data

US 2005/0115685 A1 Jun. 2, 2005

(30) Foreign Application Priority Data

Nov. 28, 2003 (TW) ..... 92221076 U

(51) Int. Cl.[7] ..... E06B 9/30

(52) U.S. Cl. ..... 160/178.1 R; 24/115 F; 24/602; 24/682.1

(58) Field of Search ..... 160/178.1 R, 172 R, 160/173 R, 168.1 R, 178.2 R; 24/115 F, 602, 682.1, 662, 116 A, 304, DIG. 11

(56) References Cited

U.S. PATENT DOCUMENTS 2,061,939 A * 11/1936 Hammer ..... 160/168.1 R
4,909,298 A * 3/1990 Langhart et al. ..... 160/178.1 R
5,533,559 A * 7/1996 Judkins ..... 160/84.06
5,542,461 A * 8/1996 Huang ..... 160/178.1 R
5,634,244 A * 6/1997 Fetsch et al. ..... 24/115 F
5,919,542 A * 7/1999 Chou ..... 428/99
6,283,191 B1 * 9/2001 Lo ..... 160/84.02
6,792,997 B2 * 9/2004 Damiano ..... 160/178.1 R
6,796,360 B2 * 9/2004 Ferrie et al. ..... 160/172 R
6,845,803 B1 * 1/2005 Nien ..... 160/178.1 R

* cited by examiner

*Primary Examiner*—David Purol
(74) *Attorney, Agent, or Firm*—Troxell Law Office, PLLC

(57) ABSTRACT

A cord retaining device for non-cord Venetian blinds include two sheltering caps, two snap members, two fixing seats, and two double-sided adhesive pieces wherein the sheltering cap has a registration cavity defined at the bottom side therein, and a through hole disposed at the top thereon. The snap member, shaped in form conforming to that of the registration cavity of the sheltering cap, has a support piece with a cord passage protruding at the top thereon, and an arc-shaped retaining cavity with an outwardly extended guide arc indented at the bottom side therein. The fixing seat has a solid coupling ball block extending at the top surface of a base thereon in match to the retaining cavity thereof, and the double-sided adhesive piece is shaped like the base of the fixing seat thereof. In assembly, retaining cords are tied up to the support pieces of the snap members by the bottom ends thereof before the snap members are registered with the ball blocks of the fixing seats that are mounted on top of the double-sided adhesive pieces fastened to both lateral sides of a windowsill. Thus, in case children curiously extending their heads out of the windowsill get caught by the retaining cords, the retaining cords pulled by the children struggling to get free there-from will draw upwards the snap members therewith and detach the retaining cavities thereof off from the ball blocks of the fixing seats in the first moment of emergency, efficiently preventing children from getting cut or strangled by the retaining cords to protect the safety of the family.

5 Claims, 4 Drawing Sheets

CORD RETAINING DEVICE FOR NON-CORD VENETIAN BLIND

BACKGROUND OF THE INVENTION

The present invention is related to a cord retaining device for non-cord Venetian blind, including two sheltering caps, two snap members, two fixing seats, and two double-sided adhesive pieces wherein retaining cords are tied up to support pieces disposed at the top of the snap members by the bottom ends thereof and the snap members have arc-shaped retaining cavities indented at the bottom side therein to be registered with coupling ball blocks of the fixing seats thereby after the fixing seats are mounted on top the double-sided adhesive pieces properly fastened at both lateral sides of a windowsill; whereby, in case a child curiously extending the head out of the windowsill get caught by the retaining cords, the retaining cords pulled by the child struggling to get free there-from will draw upwards the snap members therewith to detach the retaining cavities of the snap members from the ball blocks of the fixing seats in the first moment of emergency and thus release the retaining cords thereby, efficiently preventing children from getting cut or strangled by the retaining cords thereof to protect the safety of the family.

Refer to FIG. 1. A conventional non-pull cord operated Venetian blind is made up of a blind embodiment 10 with two retaining cords 11 attached at both lateral sides thereof wherein the retaining cords 11 are led straight downwards to be fixedly tied up to a windowsill A at the bottom ends thereof. In case children curiously extending their heads out of the window get caught by the retaining cords 11, the retaining cords 11 fixedly tied up to the windowsill A will become hard thread lines like fishing lines that can easily cut the neck of the children, or even strangle them when they struggle to get loose from the retaining cords 11 thereof. Thus, the conventional non-pull cord Venetian blind, posing a potential danger to children in the family, is not equipped with safety efficiency.

Refer to FIG. 2. A second conventional non-pull cord Venetian blind includes a blind embodiment 10', and two retaining cords 11' disposed at both lateral sides of the blind embodiment 10' thereof wherein the retaining cord 11' has a fixing ring 12' attached at the bottom end thereto for a coupling belt 131' of a fixing seat 13' to be led there-through. The coupling belt 131' of the fixing seat 13 is provided with male/female Velcro pieces 132' at the upper and lower lateral surface thereon for mutual engagement thereby after the coupling belt 131' thereof is wound through the fixing ring 12' thereof so that the retaining cord 11' thereof is led straight downwards and located onto the fixing seat 13' thereof as shown in FIG. 2.

However, the second conventional non-pull cord Venetian blind also poses a potential danger to children in the family. In case the children careless get caught by the retaining cords 11', due to the fixing rings 12' securely attached to the coupling belts 131 fastened via the male/female Velcro pieces 132', it will take some time before the male/female Velcro pieces 132' are mutually disengaged for the fixing rings 12' to get loose from the coupling belts 131 thereof. Thus, the retaining cords 11' thereof can't be efficiently released in the first moment of emergency, which can easily hurt or cut the necks of the children trying to get free there-from.

SUMMARY OF THE PRESENT INVENTION

It is, therefore, the primary purpose of the present invention to provide a cord retaining device for non-cord Venetian blinds wherein retaining cords are tied up to snap members by the bottom ends thereof and the snap members have arc-shaped retaining cavities indented at the bottom side therein to be registered with coupling ball blocks of fixing seats thereby after the fixing seats are mounted on top of double-sided adhesive pieces properly fastened at both lateral sides of a windowsill; whereby, in case children curiously extending their heads out of the windowsill get caught by the retaining cords, the retaining cords pulled by the children struggling to get free there-from will draw upwards the snap members therewith to detach the retaining cavities of the snap members off from the ball blocks of the fixing seats in the first moment of emergency and thus release the retaining cords thereby, efficiently preventing children from getting cut or strangled by the retaining cords to protect the safety of the family.

It is, therefore, the secondary purpose of the present invention to provide a cord retaining device for non-cord Venetian blinds wherein the retaining cavities of the snap members are registered with the coupling ball blocks of the fixing seats in an easy and fast manner, facilitating the assembly and operation of the present invention thereof.

DETAILED DESCRIPTION OF THE PREFERRED EMBODIMENTS

Figure 3:
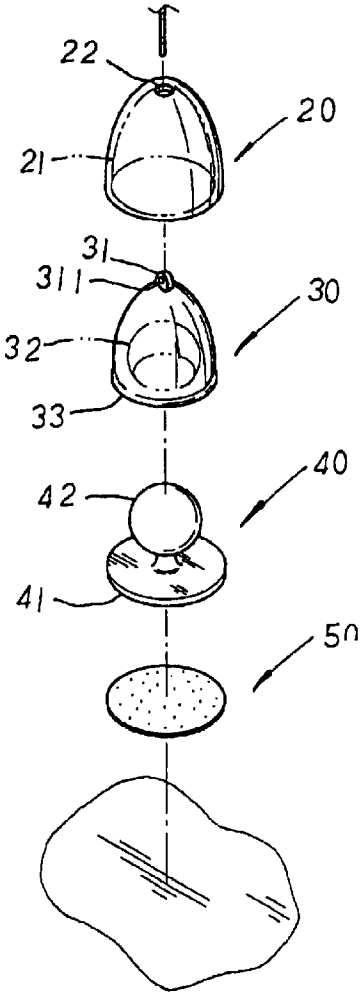
FIG. 3 is a perspective exploded view of the present invention.

Refer to FIG. 3. The present invention is related to a cord retaining device for non-cord Venetian blinds, comprising two sheltering caps 20, two snap members 30, two fixing seats 40, and two double-sided adhesive pieces 50. The sheltering cap 20 has a registration cavity 21 defined at the interior of the bottom side therein, and a through hole 22 disposed at the top thereon. The snap member 30, made of hard-with-softness plastic and shaped into form conforming to that of the registration cavity 21 of the sheltering cap 20, has a support piece 31 with a cord passage 311 disposed thereon protruding at the top thereon, an arc-shaped retaining cavity 32 indented at the Interior of the bottom side therein, and an outwardly extended guide arc 33 defining the opening of the retaining cavity 32 at the bottom thereof. The fixing seat 40, made of hard plastic, is provided with a base 41, and a solid coupling ball block 42 extending at the top surface of the base 41 thereon to be correspondingly matched to the retaining cavity 32 thereof. The double-sided adhesive piece 50 is shaped like the base 41 of the fixing seat 40 thereof.

Figure 1:
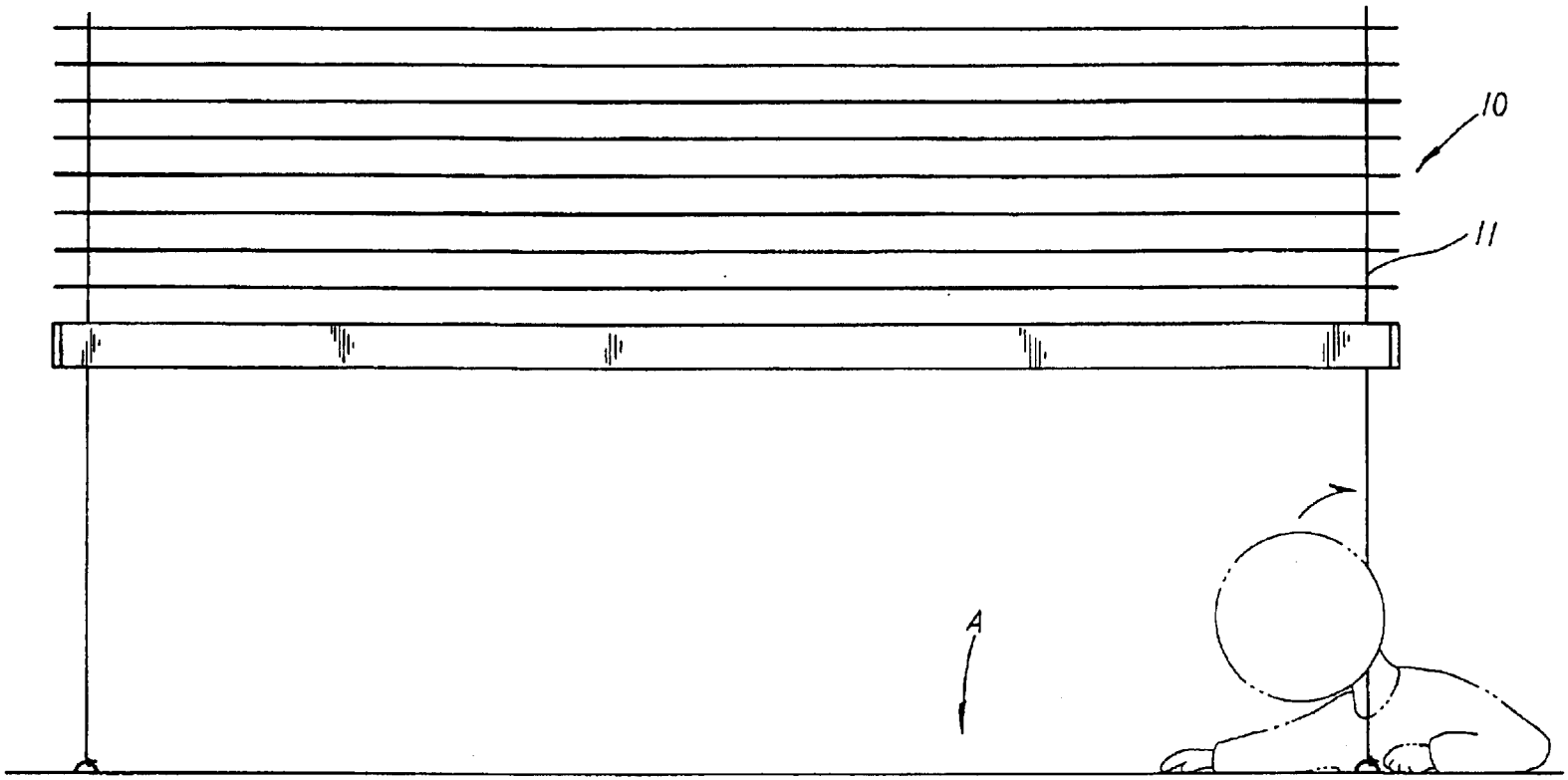
FIG. 1 PRIOR ART
FIG. 1 is a diagram showing the neck of a child getting caught by a retaining cord of a conventional non-pull cord Venetian blind in assembly.
Figure 2:
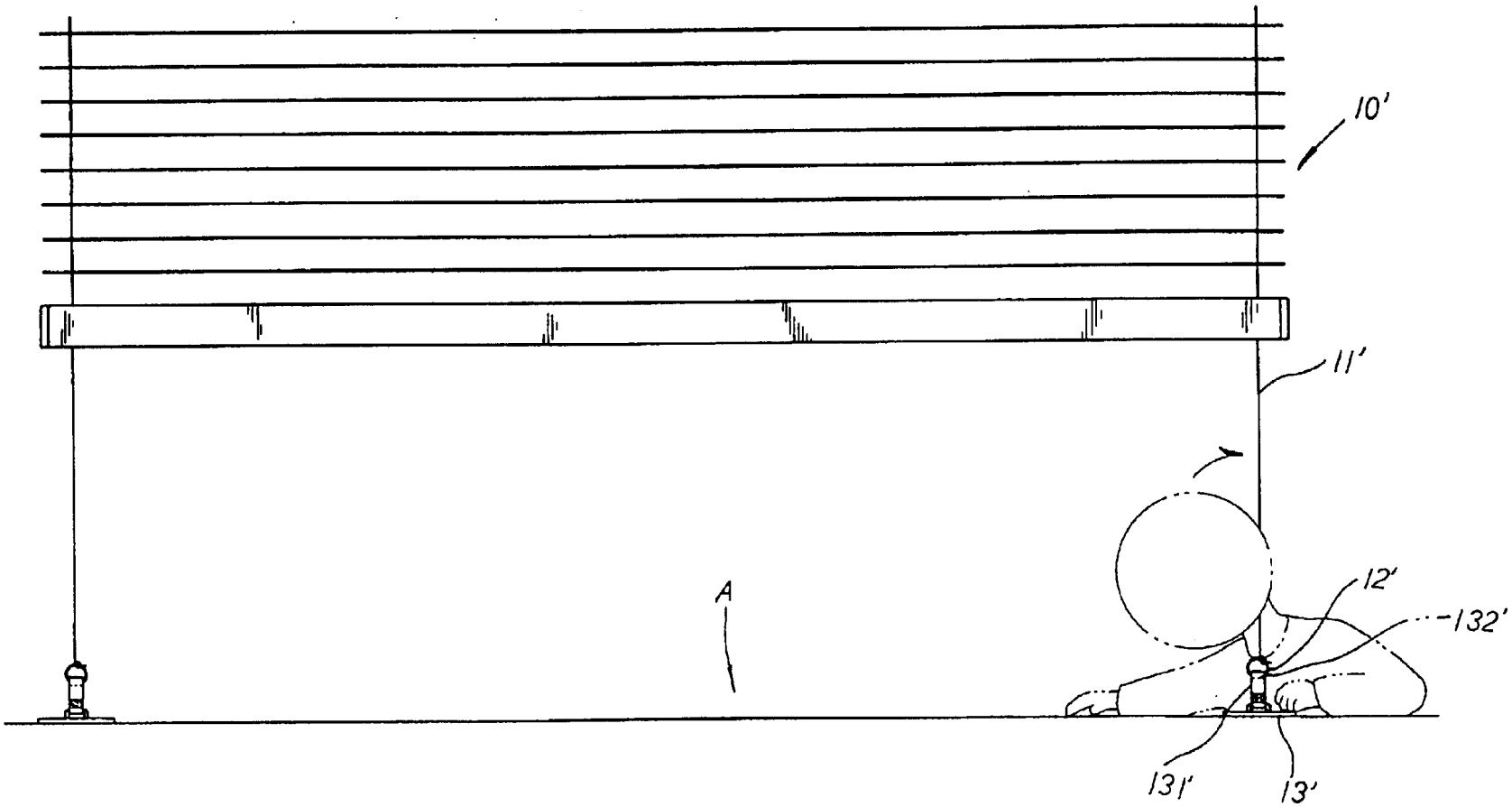
FIG. 2 PRIOR ART
FIG. 2 is another diagram showing the neck of a child getting caught by a retaining cord of a second conventional non-pull cord Venetian blind in assembly.
Figure 4:
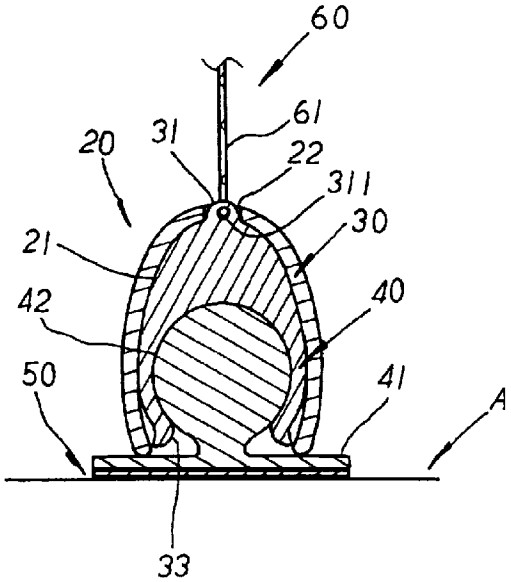
FIG. 4 is a cross sectional view of the present invention in assembly.

Refer to FIG. 4. In assembly, retaining cords 61 attached at both lateral sides of a blind 60 are led from top to bottom to pass through the through holes 22 of the two sheltering caps 20 and extend downwards at the registration cavities 21 therein respectively. Both retaining cords 61 are respectively tied up to the cord passages 311 of the snap members 30 by the bottom ends thereof before the sheltering caps 20 are guided downwards via the retaining cords 61 thereof till the support pieces 31 thereof are engaged with the through holes 22 thereof and stopped by the top surface of the snap members 30 to adapt the snap members 30 thereof completely at the registration cavities 21 of the sheltering caps 20 therein. The underside of the double-sided adhesive pieces 50 thereof is applied to the preset spot at each lateral side of a windowsill A before the bases 41 of the fixing seats 40 are respectively mounted on top of the double-side adhesive pieces 50 and securely fastened thereto at both lateral sides of the windowsill A thereon. The retaining cavities 32 of the snap members 30 are then forced downward from top to bottom via the guide arcs 33 thereof till the coupling ball blocks 42 of the fixing seats 40 are completely registered with the retaining cavities 32 to locate the snap members 30 onto the fixing members 40 thereby. The retaining cords 61 are properly adjusted into straight lines to complete the assembly of the present invention wherein the snap members 30 and the coupling ball blocks 42 of the fixing seats 40 thereof are mutually engaged in way strong enough to bear the blind 60 under normal operation thereof.

Figure 5:
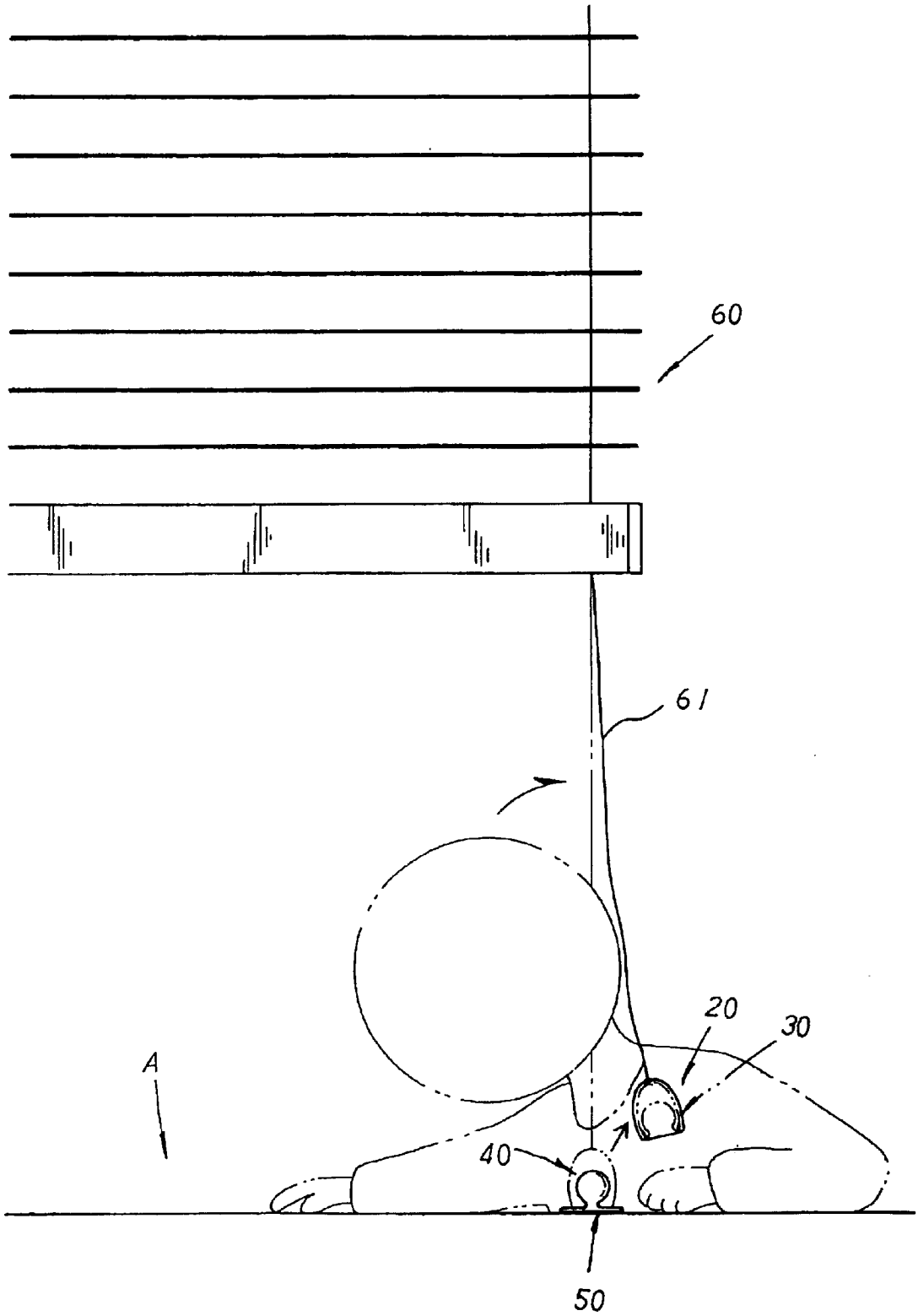
FIG. 5 is a diagram showing a snap member pulled by a retaining cord to detach from a fixing seat of the present invention in practical use.

Refer to FIG. 5. With the retaining cords 61 tied up to the support pieces 31 of the snap members 30 thereof, and the retaining cavities 32 of the snap members 30 registered with the coupling ball blocks 42 of the fixing seats 40 thereof, a child can refrain from the danger of getting cut or strangled by the retaining cords 61 when curiously extending the head out of the windowsill A and carelessly got caught by the retaining cords 61 thereof. The retaining cords 61 pulled by the force of the child struggling to get free there-from will draw upwards the snap members 30 therewith, and the guide arcs 33 thereof will quickly slide upwards along the outer periphery of the coupling ball blocks 42 thereof to detach the retaining cavities 32 thereof off from the coupling ball blocks 42 of the fixing seats 40. Thus, the retaining cords 61 are quickly and precisely released in the first moment of emergency so as to prevent children from getting cut or strangled by the retaining cords 61 thereof, efficiently protecting the safety of the family.

Meanwhile, the two sheltering caps 20 are optionally applied according to the requirement of the users. Thus, the two retaining cords 61 can be directly tied up to the support pieces 31 of the snap members 30 respectively, and the bases 41 of the fixing seats 40 are mounted onto the double-sided adhesive pieces 50 fastened to present spots at both lateral sides of the windowsill A. Finally, the retaining cavities 32 of the snap members 30 are led via the guide arcs 32 thereof to be completely registered with the coupling ball blocks 42 of the fixing seats 40 to complete the assembly thereof.

What is claimed is:

1. A cord retaining device for a non-cord Venetian blind connected to a window frame, the cord retaining device comprising:

two cord retaining device assemblies, each of the two cord retaining device assemblies having:

a) a snap member connected one of two retaining cords of the non-cord Venetian blind;

b) a fixing seat selectively connected to the snap member; and c) a double-sided adhesive piece connecting the fixing seat to a windowsill of the window frame.

2. The cord retaining device according to claim 1, wherein each member having:

a) a support piece with a cord passage protruding from a top thereof, one cord passage is connected to an end of each of the two retaining cords;

b) an arc-shaped retaining cavity located on a bottom thereof; and c) an outwardly extending guide arc located around a periphery of an opening of the arc-shaped retaining cavity.

3. The cord retaining device according to claim 1, wherein each fixing seat having a base located on a bottom thereof, the double-sided adhesive piece being connected to the base.

4. The cord retaining device according to claim 1, wherein each fixing seat having a coupling ball block located on a top thereof, one coupling ball block is removably inserted into an arc-shaped retaining cavity of each snap member.

5. A cord retaining device for a non-cord Venetian blind comprising:

a) two sheltering caps, each of the two sheltering caps having:
   i) a registration cavity located in a bottom thereof; and
   ii) a through hole located in a top thereof;

b) two snap members, each of the two snap members having:
   i) a support piece with a cord passage protruding from a top thereof;
   ii) an arc-shaped retaining cavity located on a bottom thereof; and
   iii) an outwardly extending guide arc located around a periphery of an opening of the arc-shaped retaining cavity;

c) two fixing seats, each of the two fixing seats having:
   i) a coupling ball block located on a top thereof, one coupling ball block is removably inserted into the arc-shaped retaining cavity of each snap member; and
   ii) a base located on a bottom thereof; and d) two double-sided adhesive pieces, one of the two double-sided adhesive pieces is connected to the base of each of the two fixing seats, each of the two double-sided adhesive pieces and each base of the two fixing seats have a same shape.

* * * * *